US008342512B2

(12) United States Patent
Watanabe et al.

(10) Patent No.: US 8,342,512 B2
(45) Date of Patent: Jan. 1, 2013

(54) PAPER SHEET PICK UP DEVICE

(75) Inventors: Tetsuo Watanabe, Machida (JP); Kazuya Saimei, Yokohama (JP); Takashi Hirayama, Zushi (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 86 days.

(21) Appl. No.: 12/868,888

(22) Filed: Aug. 26, 2010

(65) Prior Publication Data

US 2011/0074088 A1 Mar. 31, 2011

(30) Foreign Application Priority Data

Sep. 28, 2009 (JP) ..... 2009-221969
Nov. 11, 2009 (JP) ..... 2009-258182

(51) Int. Cl.
*B65H 1/18* (2006.01)
*B65H 1/02* (2006.01)

(52) U.S. Cl. ..... 271/152; 271/149; 271/153; 271/154

(58) Field of Classification Search ..... 271/149–155
See application file for complete search history.

(56) References Cited

U.S. PATENT DOCUMENTS 2,572,509 A * 10/1951 Novick ..... 271/150
4,523,753 A * 6/1985 Hiromori et al. ..... 271/31.1
4,595,188 A * 6/1986 Wiley et al. ..... 271/4.01
5,295,678 A * 3/1994 Lindner et al. ..... 271/152
5,556,252 A * 9/1996 Kuster ..... 414/796.7
6,702,275 B2 * 3/2004 Niiyama et al. ..... 271/98
7,413,185 B2 * 8/2008 Mitsuya et al. ..... 271/125
2002/0153654 A1 * 10/2002 Blackwell et al. ..... 271/96

FOREIGN PATENT DOCUMENTS

JP 2001-335165 12/2001
JP 2008-280139 11/2008

* cited by examiner

*Primary Examiner* — Luis A Gonzalez
(74) *Attorney, Agent, or Firm* — Pillsbury Winthrop Shaw Pittman, LLP

(57) ABSTRACT

According to one embodiment, a pick up device for paper sheets includes an input unit configured to support a plurality of paper sheets in a stacked manner, a supply mechanism configured to move the placed paper sheets in a stacking direction and supply each paper sheet to an pick up position, a pick up mechanism configured to pick up the paper sheet at the pick up position from the input unit one by one, and a control unit configured to determine a supply speed or a feed amount of the paper sheets by the supply mechanism in accordance with thickness information per unit time of the picked up paper sheets obtained from a thickness detector, and configured to determine whether the supply mechanism is to be operated or stopped based on density information of the paper sheets obtained from a paper sheet sensor.

5 Claims, 8 Drawing Sheets

PAPER SHEET PICK UP DEVICE

CROSS-REFERENCE TO RELATED APPLICATIONS

This application is based upon and claims the benefit of priority from Japanese Patent Applications No. 2009-221969, filed Sep. 28, 2009; and No. 2009-258182, filed Nov. 11, 2009; the entire contents of both of which are incorporated herein by reference.

FIELD

Embodiments described herein relate generally to a paper sheet pick up device that picks up accumulated paper sheets such as postal items one by one and feeds them.

BACKGROUND

A paper sheet processing apparatus such as a postal item processor that processes postal items such as postcards or sealed letters includes, e.g., a pick up device, a discrimination device (OCR), an accumulation device, a reject (RJ) accumulation device, a switchback device, a convey path connecting the respective devices, a gate that sorts carried paper sheets (postal items) to the respective devices, and others. A plurality of paper sheets loaded in a supply section of the pick up device are picked up one by one by the pick up device, separated into each paper sheet and are then supplied to the discrimination device. The discrimination device discriminates the paper sheets, determines a destination of the paper sheets, e.g., the RJ accumulation device or the accumulation device, and also determines whether each paper sheet is to be passed through a transfer route, e.g., the switchback device and then turned back. Afterward, each paper sheet is transferred to the determined device through the convey path and a gate mechanism, and the carried sheet is subjected to various processes in this device.

As the pick up device in the paper sheet processing apparatus, an adsorption type pick up device that adsorbs each paper sheet by a negative pressure and picks up the paper sheet has been suggested (e.g., JP-A 2008-280139 [KOKAI] and JP-A 2001-335165 [KOKAI]). This pick up device includes an air adsorption structure that uses a perforated belt and an air chamber to adsorb each paper sheet and a separation roller that adsorbs and separates a second paper sheet to prevent two paper sheets from being simultaneously picked up. Further, the pick up device includes an optical sensor that detects presence/absence or a density of paper sheets in the supply unit from which the paper sheets are supplied. When the sensor determines the absence of paper sheets by transmission, the supply unit is operated to feed the next paper sheet to a pick up position at a given speed.

In the above-described paper sheet pick up device, paper sheets are often densely stacked in e.g., a portion where paper sheets having a relatively small thickness are continuous in a paper sheet bundle placed in the supply unit. Therefore, the supply unit pushes the paper sheets at a speed higher than an ideal speed, and paper sheet jam is apt to occur near the pick up position. In this case, the earliest paper sheet cannot be stably picked up, or skew or overlapping feed of the paper sheets may possibly occur. On the contrary, a portion where paper sheets having a relatively large thickness are continuous, feed of the paper sheets by the supply unit is delayed, and hence pick up of the paper sheets may become intermittent. In such cases, a processing speed of the paper sheet processing apparatus deteriorates.

DETAILED DESCRIPTION

In general, according to one embodiment, there is provided a pick up device for paper sheets, comprising: an input unit configured to support a plurality of paper sheets in a stacked manner; supply mechanism configured to move the plurality of placed paper sheets in a stacking direction and supply each paper sheet to an pick up position on the input unit; a pick up mechanism configured to pick up the paper sheet at the pick up position from the input unit one by one; a transfer mechanism configured to transfer the paper sheets picked up by the pick up mechanism along a convey path; a thickness detector configured to detect a thickness of each paper sheet picked up by the pick up mechanism; a paper sheet sensor configured to detect a density state of the paper sheets on an upstream side of the pick up position; and a control unit configured to determine a supply speed or a feed amount of the paper sheets by the supply mechanism in accordance with thickness information per unit time of the picked up paper sheets obtained from the thickness detector, and configured to determine whether the supply mechanism is to be operated or stopped based on density information of the paper sheets obtained from the paper sheet sensor.

Embodiments will now be described hereinafter in detail with reference to the accompanying drawings.

Figure 1:
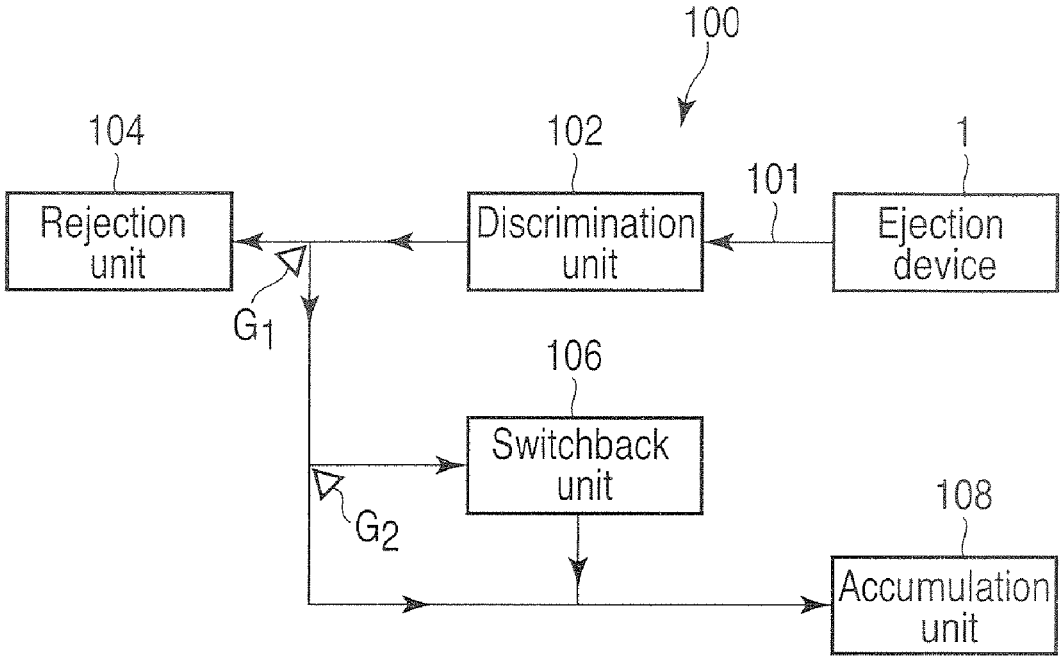
FIG. 1 is an exemplary block diagram schematically showing a postal item processing apparatus according to a first embodiment.

FIG. 1 is an exemplary block diagram schematically showing a postal item processing apparatus 100 including a pick up device 1 for paper sheets according to a first embodiment. This postal item processing apparatus 100 comprises a discrimination unit 102, a pick up unit 104, a switchback unit 106 and an accumulation unit 108 besides the pick up device 1. It is to be noted that although a paper sheet processed in the processing apparatus 100 according to this embodiment is a postal item, a processing target medium (i.e., the paper sheet) is not limited to a postal item.

A plurality of postal items such as postcards or sealed letters are stacked and loaded in the pick device 1 in this state, and they are picked up onto a convey path 101 one by one by operating the pick up device as will be described later. A plurality of pairs of endless conveyer belts (not shown) extend along the convey path 101 to sandwich the convey path 101. Each picked up postal item is held and conveyed by the conveyer belts.

The postal item picked up to the convey path 101 is supplied to the discrimination unit 102 where various kinds of information are read from the postal item. The discrimination unit 102 determines a transfer posture or a sorting destination of the postal item based on the read various kinds of information. In particular, the discrimination unit 102 reads destination information such as a postal code or an address written on the postal item and determines a sorting destination.

After passing through the discrimination unit 102, a convey direction of the postal item is sorted through a gate G1. That is, the postal item determined by the discrimination unit 102 as a postal item which should be rejected is conveyed to the rejection unit 104 through gate G1 and accumulated in the rejection unit. Other postal items are carried to the accumulation unit 108 through gate G1 and accumulated in this accumulation unit 108.

At this time, when the discrimination unit 102 determines that the convey direction of the postal item must be reversed, the postal item is supplied to the switchback unit 106 through gate G1 and a gate G2, and the convey direction is reversed in this unit 106. Each postal item whose convey direction does not have to be reversed bypasses the switchback unit 106 through gate G2 to be carried to the accumulation unit 108.

The postal item supplied to the accumulation unit 108 via the convey path 101 is sorted and accumulated in a corresponding sort and accumulation pocket (not shown) in accordance with a discrimination result in the discrimination unit 102. The postal item sorted and accumulated in each sort and accumulation pocket is accumulated in a state that its upper and lower sides are aligned.

The pick up device 1 for the paper sheets will now be described in detail.

Figure 2:
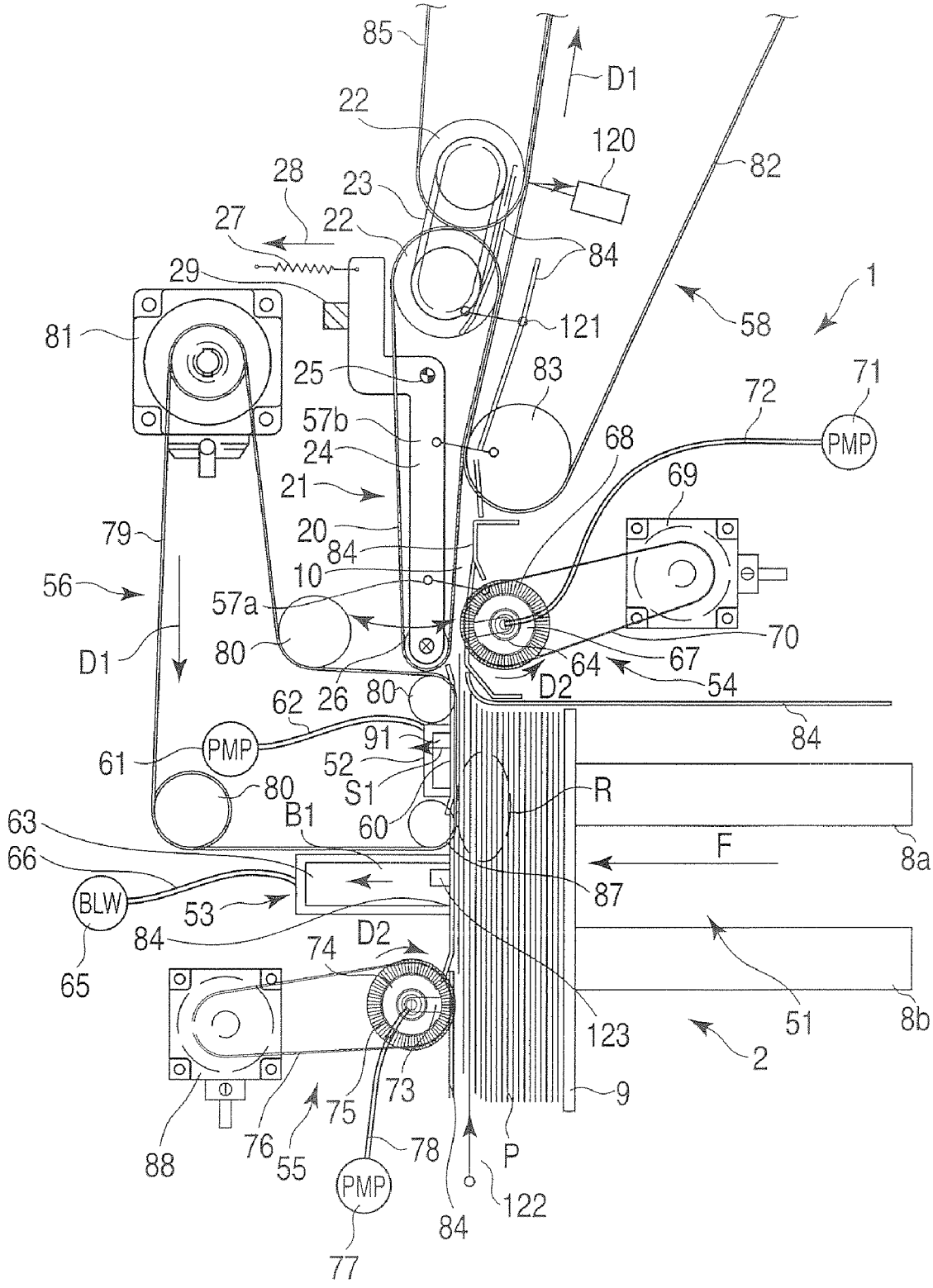
FIG. 2 is an exemplary plan view showing an pick up device in the postal item processing apparatus.

FIG. 2 is an exemplary plan view showing the pick up device 1. The pick up device 1 includes an input unit 51 in which a plurality of stacked postal items are loaded in an upright state wherein each postal item is upright substantially perpendicularly to a horizontal plane, a supply mechanism 2 that moves the plurality of input postal items P in a stacking direction and supplies the postal item P present at an end in a moving direction to a later-described pick up position 87, a pick up mechanism 56 which feeds the postal item P supplied to the pick up position 87 in a plane direction thereof which is a direction substantially perpendicular to the moving direction in this example and picks up it onto a later-described convey path 10, a suction mechanism 53 that draws the earliest postal item in the postal items P input through the input unit 51 toward the pick up position 87, a separation mechanism 54 that separates the second and subsequent postal items P which are output to follow the postal items P picked up from the pick up position 87 from the first postal item P, an auxiliary mechanism 55 that causes a negative pressure to act with respect to the postal item P supplied to the pick up position 87 on an upstream side of the pick up mechanism 56 and rotates in both forward and backward directions to aid an pick up operation for the postal item P, and a transfer mechanism 58 that extracts the postal item P having passed through the separation mechanism 54 at a speed slightly lower than an pick up speed and conveys it to a downstream side.

The pick up device 1 has two sensors 57*a* and 57*b* that detect passage of the postal item P that has been picked up onto the convey path 10 from the pick position 87 present at one end of the input unit 51 and also has a plurality of transfer guides 84. Each of the two sensors 57*a* and 57*b* has a light emitting portion and a light receiving portion to sandwich the convey path 10 along which the postal item P passes, and sequentially detects the passage of the postal item P when the postal item P blocks optical axes of these portions. Further, the plurality of transfer guides 84 come into contact with an end side or a surface of the postal item P to guide movement or transfer thereof.

The plurality of postal items P are collectively placed in the input unit 51 in a stacked state and an upright state. Two floor belts 8*a* and 8*b* are arranged on a bottom of the input unit 51. The floor belts 8*a* and 8*b* come into contact with a lower end side of each postal item P and move the postal items P in a stacking direction (direction indicated by arrow F in the drawing). A backup plate 9 is arranged at a position where it faces the postal item P present at a rear end of the plurality of postal items P in the moving direction. The backup plate 9 is connected to one floor belt 8*b*, e.g., and moves in the direction indicated by arrow F in cooperation with the floor belt 8*b*. The backup plate 9 pushes the postal items P toward the pick up position and supplies the postal item P at the end in the moving direction to the pick up position 87. That is, the two floor belts 8*a* and 8*b* and the backup plate 9 serve as a supply mechanism 2.

One transfer guide 84 extends in the direction of arrow F to define one side of the input unit 51, and it guides the end side of each postal item P. A plurality of other transfer guides 84 are arranged along the pick up position 87 on one end side of the input unit 51, serves to stop and position at the pick up position 87 the postal item P at the end of the moving position that has been supplied in the direction of arrow F and also serves to come into contact with and guide one surface of the postal item P to be picked up from the pick up position 87.

The pick up mechanism 56 has a chamber 52, a guide 60 and a vacuum pump 61 (or an equivalent). The vacuum pump 61 is connected to the inside of the chamber 52 through a pipe 62. The pick up mechanism 56 includes an endless pick up belt 79 having a portion in at least a fixed region traveling in a direction indicated by an arrow D1 in the drawing (pick up direction of the postal item P) along the pick up position 87 and a motor 81 that drives this pick up belt 79. The pick up belt 79 is wound around a plurality of rollers 80 to be stretched in such a manner that at least a part thereof travels in the direction of arrow D1 in the drawing along the pick up position 87 and the convey path 10 that continues from the pick up position 87.

Figure 3:
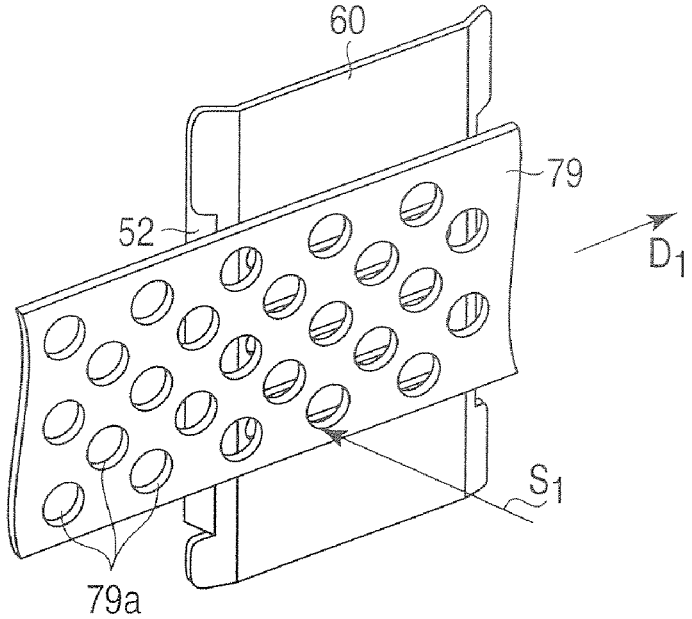
FIG. 3 is an exemplary perspective view showing an pick up belt and a guide in the pick up device.
Figure 4:
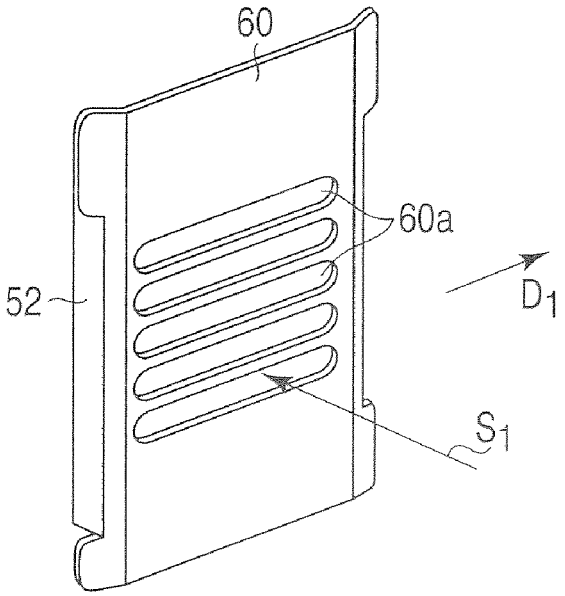
FIG. 4 is an exemplary perspective view showing the guide.

The guide 60 is arranged on the inner side of the pick up belt 79 and faces the pick up position 87 interposing the pick up belt 79 therebetween. The chamber 52 is arranged on a back surface side of the guide 60, i.e., a position where it faces the pick up position 87 to sandwich the pick up belt 79 and the guide 60. The pick up belt 79 has many adsorption holes 79*a* as shown in FIG. 3 in an enlarged manner. As depicted in FIG. 4, the guide 60 has a plurality of elongated slits 60*a* extending in the traveling direction D1 of the pick up belt 79.

As shown in FIG. 2, when the vacuum pump 61 is operated to form a vacuum in the chamber 52, a negative pressure (arrow S1 in the drawing) acts on the postal item P supplied to the pick up position 87 through an opening (not shown) of the chamber 52 facing the guide 60, the plurality of slits 60*a* of the guide 60 and many adsorption holes 79*a* of the pick up belt 79 traveling in the direction of arrow D1, and the postal item P is adsorbed on the surface of the pick up belt 79 and picked up onto the convey path 10 from the pick up position 87 with traveling of the pick up belt 79.

At this time, adsorption power of the vacuum pump 61 in the direction of arrow S1 is loaded in such a manner that transfer force for conveying the first postal item P adsorbed on the pick up belt 79 in the pick up direction D1 becomes higher than at least the frictional force acting between the first postal item P and the second postal item P. Although this pick up mechanism 56 brings up the postal items P at the pick up position 87 onto the convey path 10 one by one, the later-described separation mechanism 54 separates the plurality of postal items P brought up onto the convey path 10 in a stacked state from each other.

Figure 5:
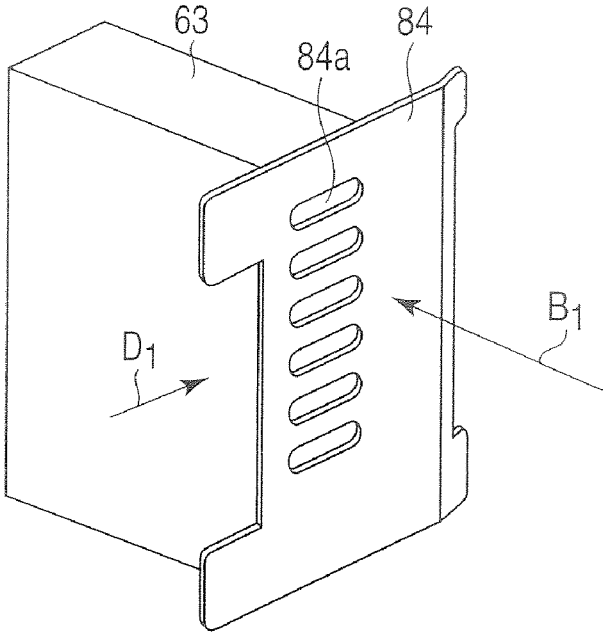
FIG. 5 is an exemplary perspective view showing a suction mechanism in the pick up device.
Figure 6:
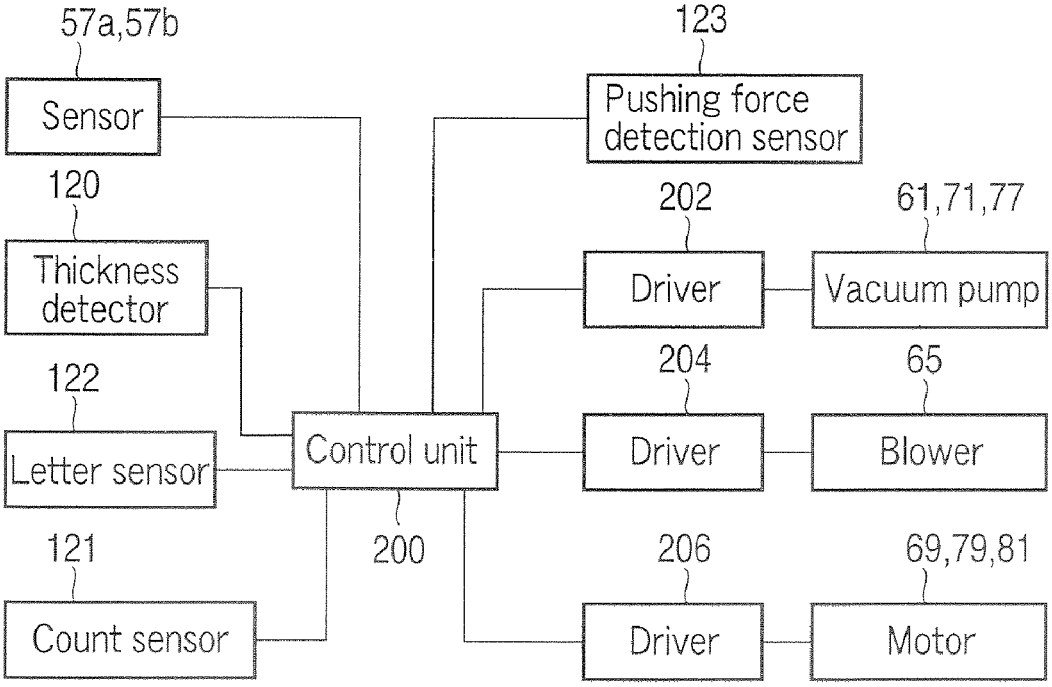
FIG. 6 is an exemplary block diagram showing a control unit and various sensors in the pick up device.

The suction mechanism 53 comprises a chamber 64 arranged on a back surface side of the transfer guide 84 with respect to the pick up position 87, and a blower 65 (or an equivalent) that draws air in the chamber 64. The blower 65 is connected to the inside of the chamber 63 through a pipe 66. The chamber 63 is arranged between the pick up mechanism 56 and the later-described auxiliary mechanism 55 and adjacent to the pick up position 87 in a posture allowing an opening portion thereof to face a back surface of the transfer guide 84. Additionally, as partially shown in FIG. 5 in an enlarged manner, the transfer guide 84 has a plurality of holes 84*a* which has a size in accordance with a width of the opening of the chamber 63. The holes 84*a* are arranged in the opening of the chamber 63.

When the blower 65 is operated to draw air in the chamber 63, an airflow is produced in the direction of arrow 51 in the drawing through the plurality of holes 84*a* of the transfer guide 84, and the postal item P closest to the pick up position 87 in the plurality of postal items P put in the input unit 51 is drawn toward the pick up position 87. After the postal item P drawn to the pick up position 87 is picked up, the next postal item P is drawn toward the pick up position 87. Providing this suction mechanism 53 enables rapidly supplying the postal item P as the next pick up target to the pick up position 87. Therefore, even if supply force in the direction of arrow F produced by the supply mechanism 2 is reduced, the first postal item P alone can be always stably and rapidly supplied to the pick up position 87. As a result, a speed of an operation of picking up the postal item P by the pick up mechanism 56 can be increased.

The separation mechanism 54 is provided on the opposite side of the pick up mechanism 56 with respect to the convey path 10 extending on the downstream side (upper side in FIG. 2) of the pick up position 87. This separation mechanism 54 imparts a separation torque in a direction opposite the pick up direction of the postal item P while applying a negative pressure to the postal item P carried through the convey path 10. That is, when this separation mechanism 54 is operated, the second and subsequent postal items P are stopped or returned in the opposite direction by the negative pressure and the separation torque even though the second and subsequent (three or more postal items may be picked up in a stacked state) postal items P are output to follow the postal item P that is picked up from the pick up position 87, thereby separating these postal items P from the first postal item P.

In more detail, the separation mechanism 54 comprises a separation roller 68 rotatable in both forward (the pick up direction D1) and backward directions. The separation roller 68 is formed of a rigid body, e.g., a substantially cylindrical metal material, and it is arranged at a position where its outer peripheral surface is exposed to the convey path 10. The separation roller 68 is rotatably provided on a rotating shaft, i.e., a cylindrical body 67 having a later-described chamber 64. The separation roller 68 has many adsorption holes penetrating the roller 68 and open to an inner peripheral surface and an outer peripheral surface thereof. The cylindrical body 67 has a chamber 64 configured to generate a negative pressure, and it is positioned in a posture that an opening of this chamber 64 faces the convey path 10.

The separation mechanism 54 has an AC servo motor 69 that rotates the separation roller 68 in both the forward and backward directions with a desired torque and an endless timing belt 70 configured to transmit driving force of this motor 69 to the separation roller 68. The timing belt 70 is wound and stretched around a pulley secured to the rotating shaft of the motor 69 and a non-illustrated pulley secured to a rotating shaft of the separation roller 68. Furthermore, the separation mechanism 54 includes a vacuum pump 71 connected with the chamber 64 of the cylindrical body 67 through a pipe 72.

When the vacuum pump 71 is operated to form a vacuum in the chamber 64, a negative pressure is caused to act with respect to a surface of the postal item P that passes through the convey path 10 via the opening of the chamber 64 and specific adsorption holes facing the opening of the chamber 64 in many adsorption holes of the separation roller 68, and the postal item P is adsorbed on the outer peripheral surface of the separation roller 68. At this time, when the separation roller 68 is rotating, transfer force of the separation roller 68 in the rotating direction is also given to the postal item P adsorbed on the outer peripheral surface of the separation roller 68.

On the other hand, the AC servo motor 69 drives the separation roller 68 to constantly impart a fixed separation torque in a direction D2 opposite to the pick up direction D1 to the separation roller 68. When the number of the postal item P carried through the convey path 10 is one, this separation torque is set to a level that enables the separation roller 68 that has adsorbed the one postal item P to rotate together with the postal item P in the pick up direction D1. When the plurality of postal items P are picked up onto the convey path 10 in the stacked state, the separation torque is set to a level that enables stopping or returning the second and subsequent postal items P on the separation roller 68 side to the opposite direction, whereby these postal items P can be separated from the first postal item P.

In a state that one postal item P is normally picked up from the pick up position 87 and carried through the convey path 10, transfer force in a forward direction (direction of arrow D1) applied to the postal item P by the pick up mechanism 56 is larger than transfer force in the opposite direction applied to the postal item P by the separation roller 68 that has received the separation torque in the opposite direction D2, the postal item P is carried in the forward direction D1, and the separation roller 68 rotates in the forward direction D1 together with the postal item P and stops or runs idle in the direction opposite to the pick up direction.

In a case where the separation roller 68 runs idle in the opposite direction D2, a rotating speed gradually increases when the fixed separation torque is continuously imparted. As a result, the pick up of the postal item P may be adversely affected. To avoid this advantage, an upper limit is put on a reverse rotation speed of the separation roller 68 in this embodiment. Specifically, there is set an upper limit speed having an absolute value smaller than a pick up speed of the postal item P.

As shown in FIG. 2, the auxiliary mechanism 55 is arranged on the lower side of the suction mechanism 53 in the drawing, i.e., on the upstream side of the pick up mechanism 56 in the pick up direction D1 of the postal item P and comprises substantially the same configuration as the separation mechanism 54. That is, the auxiliary mechanism 55 comprises an auxiliary roller 75 rotatable in both the forward direction D1 and the backward direction D2.

The auxiliary roller 75 is rotatably provided on a rotating shaft, i.e., a cylindrical body 74 fixedly arranged to face the pick up position 87. The auxiliary roller 75 has many adsorption holes penetrating the roller 75 and open to an inner peripheral surface and an outer peripheral surface thereof. The auxiliary roller 75 is formed of a rigid body such as a substantially cylindrical metal material, and its outer peripheral surface is positioned to expose to the pick up position 37. The cylindrical body 74 has a chamber 73 configured to generate a negative pressure. The cylindrical body 74 is positioned in a posture that an opening of this chamber 73 faces the pick up position 87.

The auxiliary mechanism 55 comprises an AC servo motor 88 configured to rotate the auxiliary roller 75 in both the forward and backward directions with a desired torque and an endless timing belt 76 configured to transmit driving force produced by this motor 88 to the auxiliary roller 75. The auxiliary mechanism 55 has a vacuum pump 77 connected through a pipe 78 to the chamber of the cylindrical body 74.

The auxiliary mechanism 55 rotates the auxiliary roller 75 in both the forward and backward directions at a desired speed and stops the same, and it also supports a pick up operation and a separating operation of the postal items P by turning on/off the negative pressure generated by the vacuum pump 77.

As shown in FIG. 2, the transfer mechanism 58 that transfers the postal item P picked up by the pick up mechanism 56 to the downstream side comprises a plurality of transfer rollers 22 and 83, a tension roller 26, transfer belts 20, 82 and 85, and a tension mechanism 21. The transfer roller 83 is arranged on the downstream side of the separation roller 68 and adjacent to the convey path 10. The transfer belt 82 is wound around this transfer roller 83 and the other non-illustrated transfer roller. The transfer belt 20 is wound around the tension roller 26 and the transfer roller 22, and this transfer belt 20 defines the convey path 10 together with the convey path 10 and is in contact with the transfer belt 82.

The tension mechanism 21 includes a tension arm 24 having a central portion rotatably supported by a pivot 25. The tension roller 26 is rotatably supported at one end of the tension arm 24. A tension spring 27 is installed at the other end of the tension arm 24 to be urged. As a result, the tension arm 24 is urged in a counterclockwise direction around the pivot 25 and elastically comes into contact with a stopper 29. As a result, the tension roller 26 and the transfer belt 20 are urged in the direction of the convey path 10, and the transfer belt 20 is in contact with the transfer belt 82 in a state that tensile force is maintained. Furthermore, the transfer belt 85 is wound around the other transfer roller 22 and the non-illustrated other transfer roller, and the transfer belt 85 is in contact with the transfer belt 82. A drive belt 23 configured to synchronously rotate the two transfer rollers 22 is wound around these rollers. The postal item P is held between the transfer belt 82 and the transfer belts 20 and 85 and carried by these transfer belts.

As shown in FIGS. 2 and 3, the pick up device 1 includes a thickness detector 120 which detects a thickness of the picked up postal items P and a count sensor (counter) 121 which counts the number of picked up postal items P. The thickness detector 120 and the count sensor 121 are provided to the convey path 10 on the downstream side of the sensors 57*a* and 57*b*. Moreover, on the upstream side of the pick up position 87, the pick up device 1 includes a letter sensor (paper sheet sensor) 122 which detects presence/absence or a density of the postal items P placed in the input unit 51 and a pushing force detection sensor 123 which detects pushing force for the postal items P generated by the supply mechanism 2, especially pushing force that acts on the earliest postal item P. It is to be noted that the thickness detector 120 may also serve as the count sensor 121.

The sensors 57*a* and 57*b*, the thickness detector 120, the count sensor 121 and the letter sensor 122 are connected to the control unit 200 of the pick up device 1 to input each detection signal to the control unit 200. To this control unit 200 are connected a driver 202 which drives the vacuum pumps 61, 71 and 77, a driver 204 which drives the blower 65 and a driver 206 which drives the AC servo motors 69, 79 and 81, and the control unit 200 drives each driver in accordance with a detection signal from each sensor.

The letter sensor 122 is provided at a position near the upstream side of the pick up position 87, and a transmitting or reflecting optical sensor or other various sensors can be used as this sensor. The letter sensor 122 detects presence/absence of the postal item P on an optical axis of the sensor 122 or detects a density of the postal item P as an example of its role. When the control unit 200 determines that presence of the postal items P accumulated near the pick up position 87 is sparse (although a letter edge is detected, but many gaps are present to allow the optical axis to pass therethrough) based on a detection signal from the letter sensor 122, it moves the supply mechanism 2 to urge an operation of feeding the postal items P to the pick up position 87. A detection direction of the letter sensor 122 is not restricted to the drawing, and it is possible to select various directions, e.g., a direction along which each postal item is detected from the front side of the postal item P or the lower side of the postal item P.

As the pushing force detection sensor 123, for example, a pressure sensor or a sensor that detects a pushing amount of a lever by utilizing the lever and a spring can be used for determining how much the postal item P is pushed toward the pick up position 87. For example, when the control unit 200 determines that the postal item P is not pushed at all, i.e., when detected pushing force is smaller than a reference value based on a detection signal from the pushing force detection sensor 123, it moves the supply mechanism 2 to urge an operation of feeding the postal item P to the front side. Additionally, when the postal item P is excessively pushed, i.e., when the detected pushing force is smaller than the reference value, the control unit 200 can alleviate an excessive jam state of the postal items P by operating the supply mechanism 2 in the opposite direction. The pushing force detection sensor 123 may measure the pushing force itself or may detect presence/absence of the postal items P alone.

Figure 7:
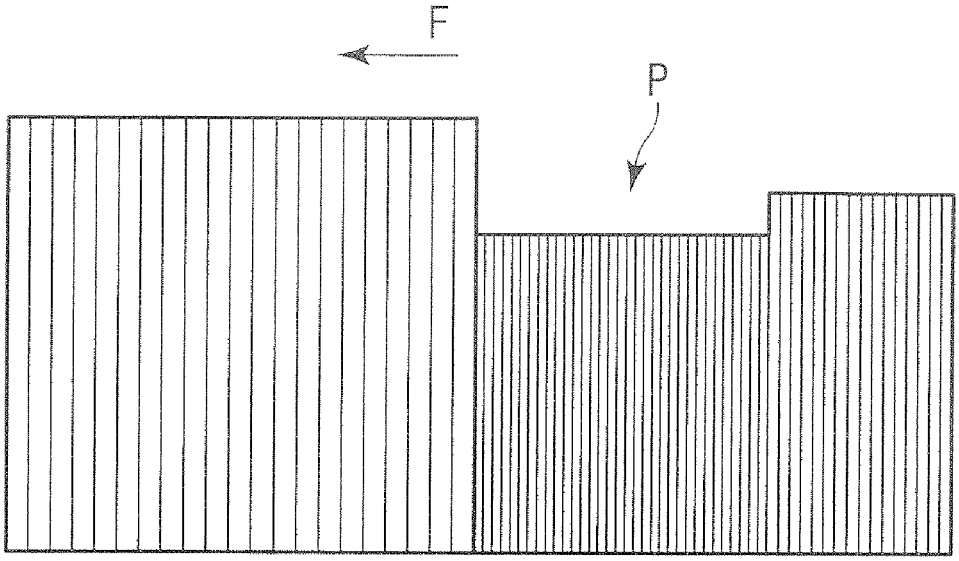
FIG. 7 is an exemplary view schematically showing a state that postal items having the same thickness are loaded in the pick up device.

In the postal item processing apparatus, as shown in FIG. 7, in regard to how the postal items P are loaded and placed in the input unit 51 are placed, for example, postal items having the same thickness (same type) are often present in a state that they are continuous to some extent (bulk state).

In this embodiment, for example, when the thickness detector 120 measures a thickness of each postal item P picked up by the pick up mechanism 56, the control unit 200 estimates a thickness of the postal item P that is present in a region R near pick up position 87 of the input unit 51. When the control unit 200 determines that the thickness of each postal item P in the region R near the pick up position is smaller than a predetermined reference value, it decides that the postal items P are apt to jam and a phenomenon that the postal items are nipped at the pick up position 87 occurs if a supply speed V is unchanged, and hence it reduces the supply speed V. Contrary, when the control unit 200 determines that the thickness of each postal item P in the region R is larger than the predetermine reference value, it decides that the postal items become sparse and pick up of the postal items P become intermittent, and hence it increases the supply speed V.

Figure 8:
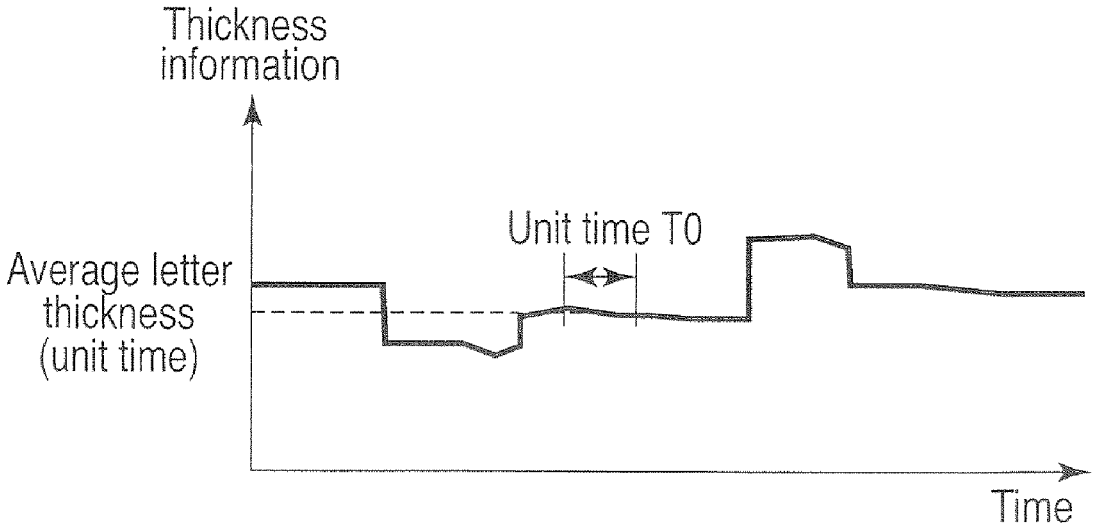
FIG. 8 is an exemplary view showing a change in thickness of postal items per unit time the pick up device.

The thickness detector 120 can adopt a method based on distance measurement using a laser displacement gauge (optical system) or various thickness detection methods based on a contact system. As shown in FIG. 8, the control unit 200 measures a thickness of each postal item P by using the thickness detector 120 and calculates a unit time average value TH of thicknesses of the postal items that have passed per unit time T0. Here, as shown in FIG. 7, when the bulk state of the postal items P continues, it can be assumed that thickness information is substantially fixed, and it can be considered that the average value TH calculated here is equal to a thickness of each postal item P present in the region R near the pick up position of the input unit 51.

Figure 9A:
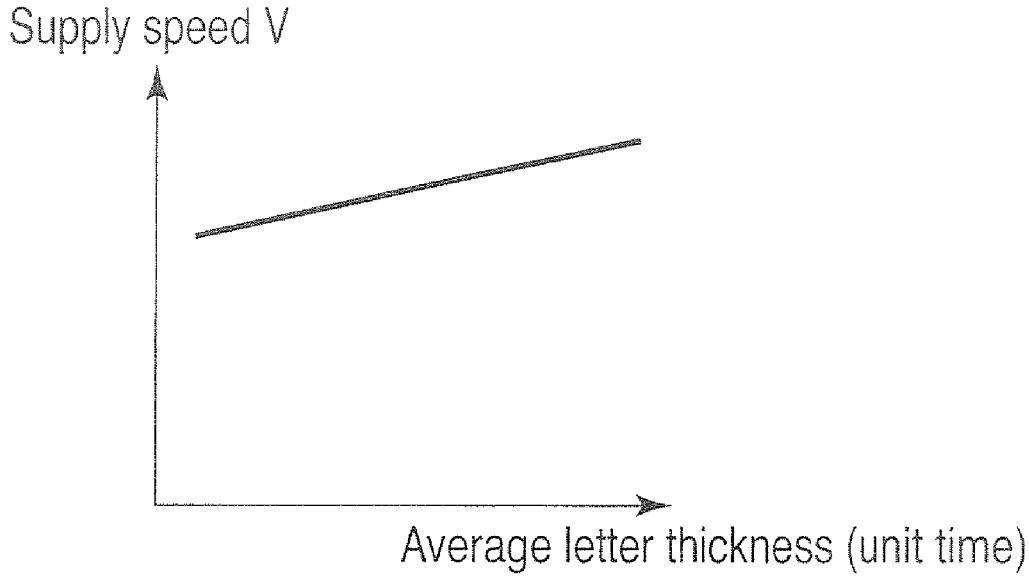
FIGS. 9A and 9B are exemplary views each showing a relationship between a thickness of a postal item and a feed speed.
Figure 9B:
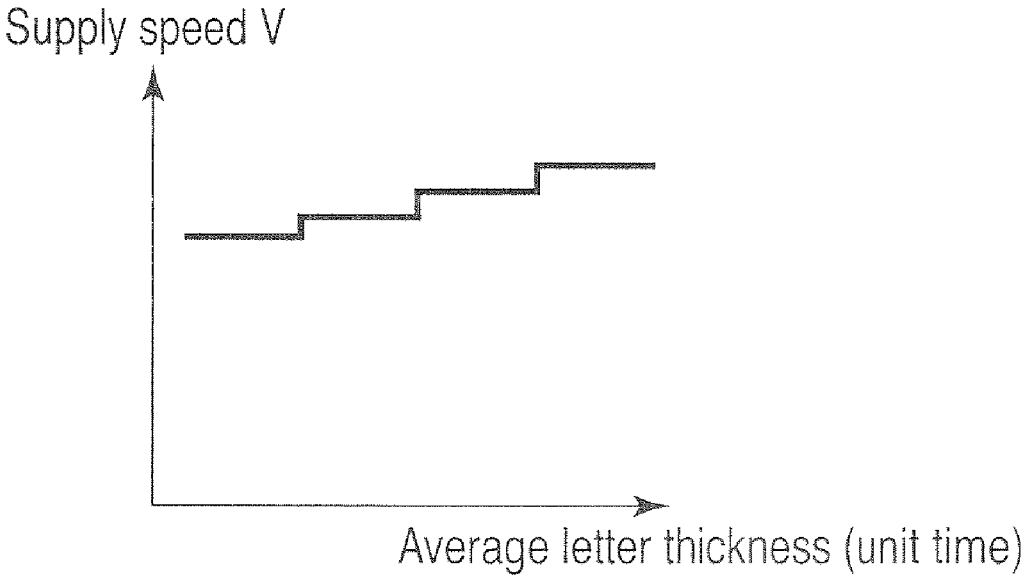

When an appropriate feed speed is set in accordance with the assumed thickness information of each postal item P in the region R, i.e., a type of each postal item as shown in FIG. 9A, a smooth supply operation is performed. In this embodiment, as depicted in FIG. 9B, the control unit 200 divides the calculated thickness information per unit time into a plurality of sections to define a parameter for the supply speed V.

When the type (thickness) of the postal item P to be picked up varies, the calculated information TH based on a measurement value from the thickness detector 120 does not coincide with the thickness of the postal item P in the region R, but shortening the unit time T0 enables suppressing an influence in this case.

Further, the control unit 200 may count the number of the picked up postal items P that have passed per unit time based on a detection signal from the count sensor 121 and set the supply speed V for the number of postal items that have passed per unit time. For example, when the number of postal items that have passed per unit time is larger than a predetermined reference value, the control unit 200 estimates that a reduction in the postal items P present in the region R near the pick up position of the input unit 51 is slow, and it increases the supply speed V beyond a predetermined speed.

In this embodiment, although the supply speed of the supply mechanism 2 is changed, but a supply amount may be variably determined to control a supply operation for the postal items. For example, the control unit 200 calculates total letter thickness information per unit time by using the thickness detector 120 and estimates a total amount (feed amount, feed width) of the postal items P that are no longer present after pick up from the region R near the pick up position of the input unit 51. Further, the control unit 200 determines the estimated total amount as a feed amount to effect a supply operation of the supply mechanism 2.

Detection information from the thickness detector 120 and the count sensor 121 may be also utilized to determine the supply speed V or a feed amount of the supply mechanism 2.

According to the postal item processing apparatus including the thus configured pick up device 1, the thickness detector 120 is utilized to detect a thickness of each picked up postal item P, a thickness of each postal item P in the region near the pick up position of the input unit 51 is estimated, and an optimum supply speed for the postal item P in the input unit is adjusted or a feed amount is changed, thereby carrying out the smooth supply operation. Moreover, the number of picked up postal items P that have passed per unit time may be counted to set the supply speed V for the number of postal items that have passed per unit time. Therefore, the postal items P can be stably picked up one by one at a high speed without being affected by a difference in thickness between the postal items P. Additionally, when the count sensor 121 detects the number of postal items picked up per unit time, a pick up amount of the postal items in the region near the pick up position is estimated and the appropriate supply speed or feed amount of the supply mechanism 2 is changed, the more smooth supply operation can be effected. As a result, the appropriate supply can be performed and the stable pick up can be carried out, thereby obtaining the paper sheet processing apparatus having an improved processing speed.

Figure 10:
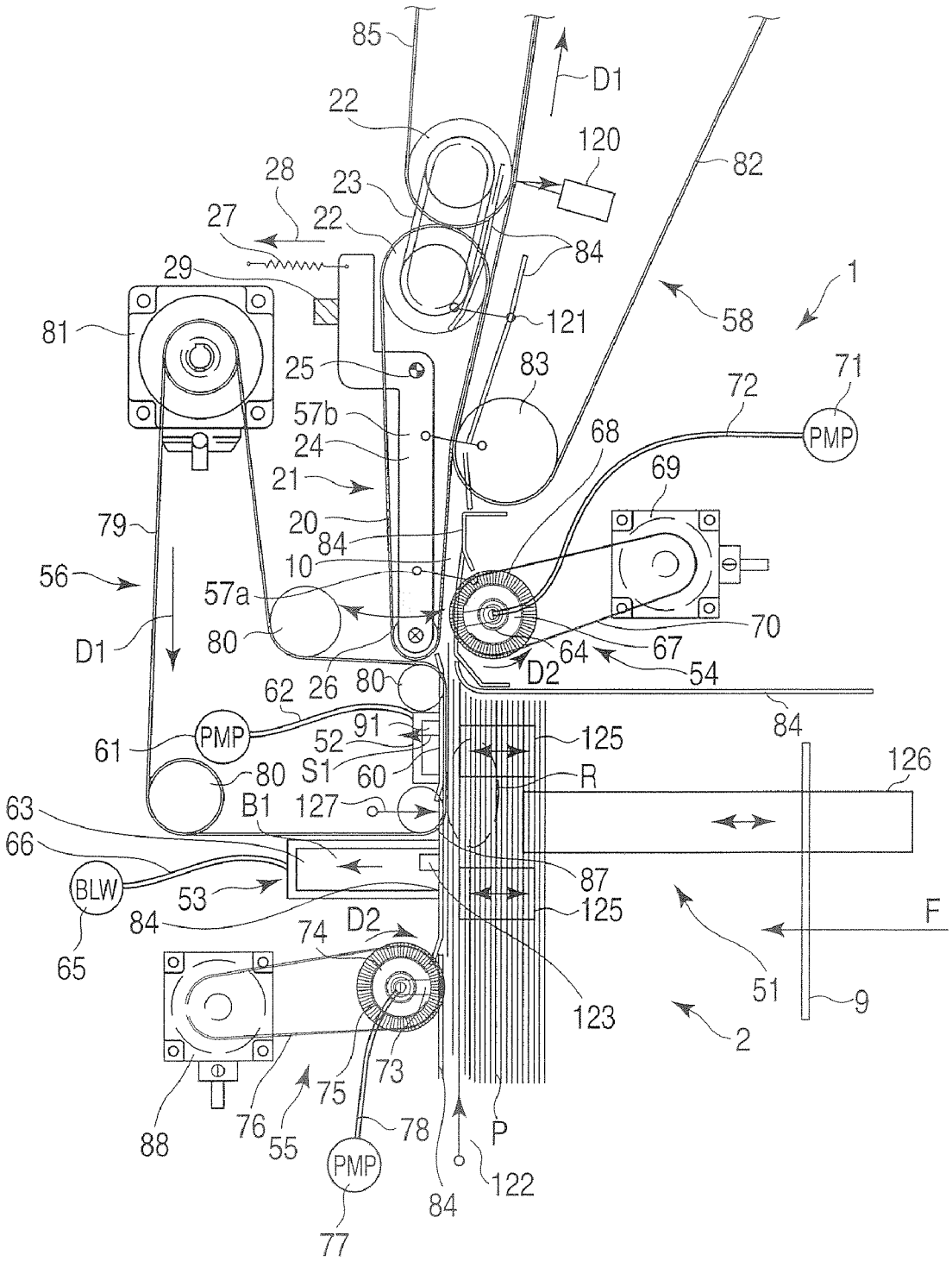
FIG. 10 is an exemplary plan view showing an pick up device according to a second embodiment.

A postal item processing apparatus including an pick up device according to a second embodiment will now be described. FIG. 10 is a plan view showing an pick up device 1 for postal items according to the second embodiment. According to this embodiment, a control unit 200 estimates a posture of each postal item P in an input unit 51 by using both a thickness detector 120 and a count sensor 121 to check each piece of obtained information. A supply mechanism 2 has a main belt 126 configured to feed each postal item P in a feed direction F and a pair of sub-belts 125, and it can independently drive these belts. The sub-belts 125 are provided on a downstream side of the main belt 126, i.e., at positions closer to an pick up position 87 in the feed direction F. The supply mechanism 2 has a backup plate 128 that pushes a rear surface of a group of postal items P, and this backup plate 128 is connected with the main belt 126 and driven in synchronization with the main belt. The pick up device 1 has one or more optical sensors 127 configured to detect each postal item P from a front surface side.

Other structures of the postal item processing apparatus are equal to those in the first embodiment, and like reference numbers denote like parts, thereby omitting a detailed description thereof.

Figure 11:
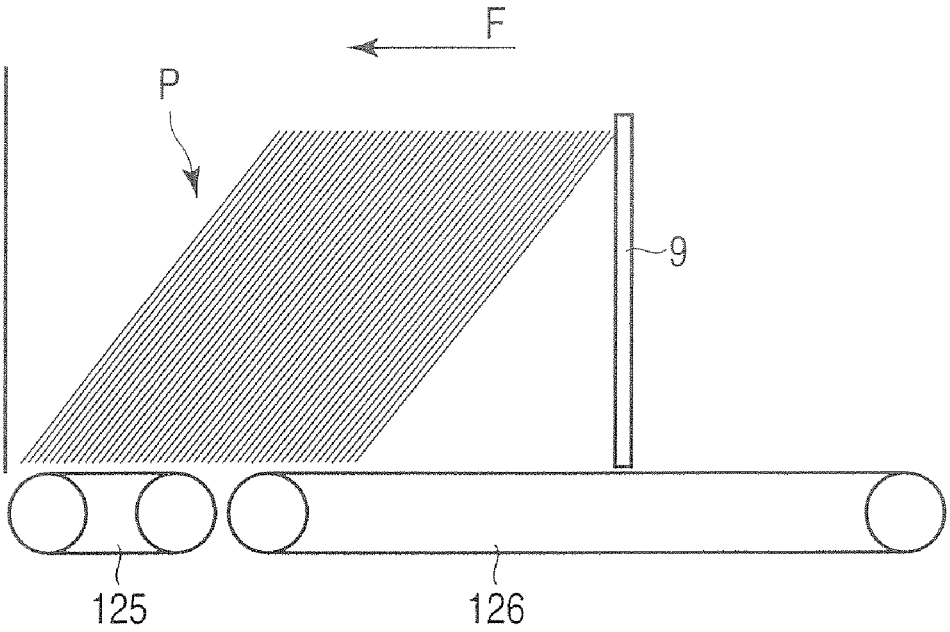
FIG. 11 is an exemplary view showing a postal item group loaded in an obliquely inclined state in the pick up device.

In the second embodiment, for example, when it is determined that "a thickness of a postal item P is small" from information obtained from the thickness detector 120 and it is also determined that "a processing speed is lower than a predetermined counterpart" from information obtained from the count sensor 121, it is estimated that the postal item P loaded near an pick up position 87 of an input unit 51 takes a posture that noticeably falls down obliquely backward as shown in FIG. 11. Although there is a possibility that the postal item P falls down, but whether the postal item P takes an inclined posture as shown in FIG. 11 or falls down can be determined by multilaterally determining information from an optical sensor 127 or information from a pushing force detection sensor 123. In this case, it can be estimated that the postal item P has a small thickness and a light weight, but this means that a processing speed for the postal item, i.e., a pick up speed cannot be increased since the postal item P in the input unit 51 takes a bad posture.

Figure 12:
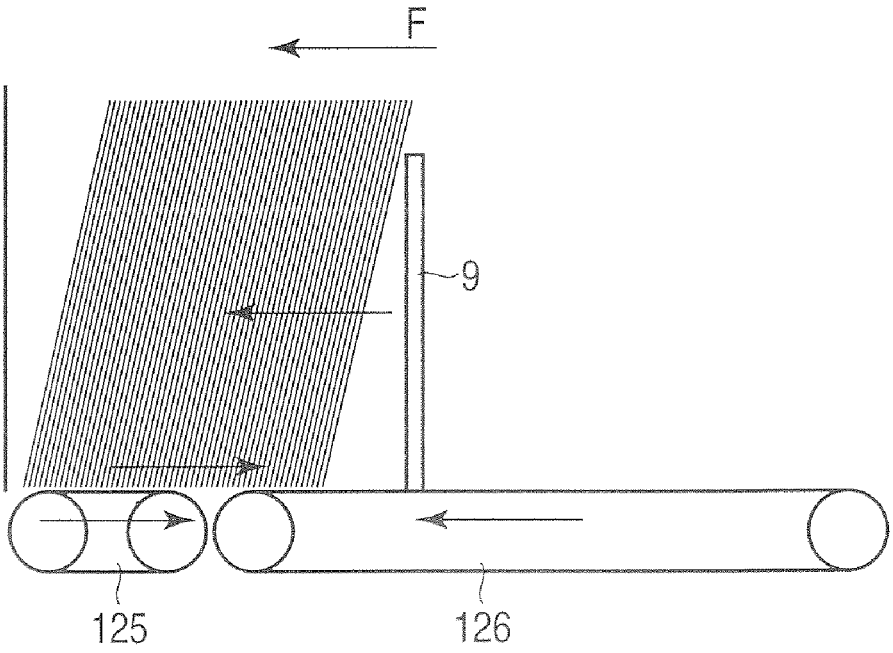
FIG. 12 is an exemplary view showing a posture correction operation of the postal item group in the pick up device.

Thus, when the control unit 200 determines that "a thin postal item is present near the pick up position of the input unit and its posture obliquely falls down" based on detection information obtained from the thickness detector 120, the count sensor 121 and the optical sensor, it drives a supply mechanism 2 to raise the postal item P and restores a processing speed. That is, the control unit 200 controls driving speeds and driving directions of a main belt 126 and sub-belts 125 to straighten the posture of the postal item P. As an example of an operating method of raising the postal item P, as shown in FIG. 12, the control unit 200 rotates the main belt 126 in a forward direction while rotating the sub-belts 125 in a backward direction (feeding these belts in a direction opposite to the pick up position 87) and pushes a rear surface of a group of the postal items P in an pick up direction F by using a backup plate 9, thereby raising the postal item P. As a result, a smooth supply operation for the postal items can be carried out, and the pick up device 1 can be utilized to stably eject the postal items at a high speed. Therefore, the pick up can be continued without reducing a processing speed. Besides, the second embodiment can obtain the same functions and effects as in the first embodiment.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit the inventions. The accompanying claims and their equivalents are intended to cover such forms or modifications as would fall within the scope and spirit of the inventions.

What is claimed is:

1. A pick up device for paper sheets, comprising:

an input unit configured to support a plurality of paper sheets in a stacked manner;

a supply mechanism configured to move the plurality of placed paper sheets in a stacking direction and supply each paper sheet to an pick up position on the input unit;

a pick up mechanism configured to pick up the paper sheet at the pick up position from the input unit one by one;

a transfer mechanism configured to transfer the paper sheets picked up by the pick up mechanism along a convey path;

a thickness detector configured to detect a thickness of each paper sheet picked up by the pick up mechanism;

a paper sheet sensor configured to detect a density state of the paper sheets on an upstream side of the pick up position; and a control unit configured to determine a supply speed or a feed amount of the paper sheets by the supply mechanism in accordance with thickness information per unit time of the picked up paper sheets obtained from the thickness detector, and configured to determine whether the supply mechanism is to be operated or stopped based on density information of the paper sheets obtained from the paper sheet sensor, wherein the control unit is further configured to calculate an average value of thicknesses per unit time obtained by the thickness detector, to decrease the supply speed when the average value is lower than a predetermined reference value, and to increase the supply speed when the average value is higher than the predetermined reference speed.

2. The device according to claim 1, further comprising a counter configured to count the number of paper sheets picked up by the pick up mechanism, the control unit is configured to determine a supply speed or a feed amount of the supply mechanism in accordance with information of the number of paper sheets picked up per unit time obtained by the counter.

3. The device according to claim 1, further comprising a pushing force detection sensor configured to detect pushing force for the paper sheet given by the supply mechanism, wherein the control unit is configured to feed each paper sheet toward the pick up position by the supply mechanism when the pushing force detected by the pushing force detection sensor is smaller than a reference value, and to operate the supply mechanism in an opposite direction to alleviate jam of the paper sheet, when the pushing force detected by the pushing force detection sensor is larger than the reference value.

4. The device according to claim 1, further comprising a separation mechanism configured to separate a second and subsequent paper sheets which are taken out following the paper sheet picked up from the pick up position.

5. The device according to claim 4, wherein the separation mechanism is arranged on a downstream side in a pick up direction of the pick up mechanism and on an opposite side of the convey path with respect to the pick up mechanism, and configured to apply a negative pressure to the paper sheet picked up onto the convey path to separate the paper sheet.

* * * * *